United States Patent [19]

Belieff et al.

[11] Patent Number: 4,720,941

[45] Date of Patent: Jan. 26, 1988

[54] SELF-COOLING, NON-LOADING ABRADING TOOL

[75] Inventors: John R. Belieff, DeLeon Springs, Fla.; Clarence E. Southward, Milan, Mich.

[73] Assignee: Jo-Ed Enterprises, Inc., DeLeon Springs, Fla.

[21] Appl. No.: 877,137

[22] Filed: Jun. 23, 1986

[51] Int. Cl.[4] ..... B24D 5/10

[52] U.S. Cl. ..... 51/204; 51/206 R; 51/209 R; 51/298

[58] Field of Search ..... 51/204, 206 R, 209 R, 51/298, 356

[56] References Cited

U.S. PATENT DOCUMENTS 3,074,211 1/1963 Sacco ..... 51/206 R 3,142,138 7/1964 Kean et al. ..... 51/206 R 3,183,633 5/1965 Decker ..... 51/206 R 3,747,281 7/1973 Fedjukin et al. ..... 51/204

FOREIGN PATENT DOCUMENTS 3031657 3/1982 Fed. Rep. of Germany ..... 51/298

*Primary Examiner*—Robert P. Olszewski

*Attorney, Agent, or Firm*—Charles R. Rhodes; Judith E. Garmon

[57] ABSTRACT

A tool for sanding, grinding, or polishing ferrous or non-ferrous work pieces which includes a plurality of abrasive particles, such as silica sand or the like, embedded in a binder matrix formed primarily of polytetrafluoroethylene and equivalent polymers. The matrix may further include a stiffening agent for adding rigidity to the tool, such as ground glass.

4 Claims, 6 Drawing Figures

SELF-COOLING, NON-LOADING ABRADING TOOL

BACKGROUND AND SUMMARY OF THE PRESENT INVENTION

Figure 1:
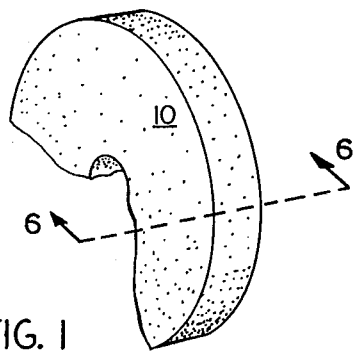
Figure 2:
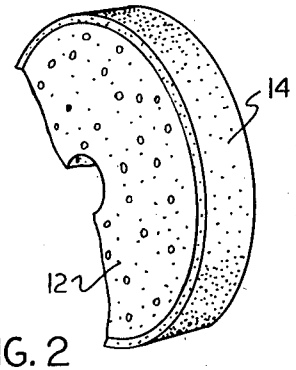

This invention relates to abrading tools, and more specifically to a self-cooling non-loading abrasive tool.

It is commonplace in industrial applications to grind a surface, whether it be ferrous or non-ferrous to achieve a desired finish. Conventional grinding operations are accomplished by the rapid rotation or reciprocation of abrading tools of various configurations, such as wheels, discs, strips, and the like. The rapid movement of the abrading tool against the work piece generates significant heat which can be a problem. Such problems include the deterioration of the grinding tool, the loss of the tool's ability to maintain desired tolerances and the rapid loading (clogging) of the abrasive particles to the extent that they no longer accurately or satisfactorily perform their function.

There have been various attempts in the prior art to improve the effects of heat generation during the abrading operation. Some such approaches simply supply air or a coolant fluid (water) directly to an abrasive tool. Other attempts utilize materials in the binder which have high heat conductivity to conduct the heat away from the surface of the tool and to remote points where coolant is provided or where air openings are provided. Such examples are illustrated and described in U.S. Pat. Nos. 3,641,718 and 3,742,655. Other materials which the prior art discloses as being useful for forming the binder matrix include rubber, polyvinyl acetate, phenol formaldehyde, rosin, urea formaldehyde, heat resistant silicon resins, and phenolic resin (U.S. Pat. No. RE 25076). While such approaches have, in general, been somewhat successful, they are for the most part expensive and do not substantially solve the loading (clogging) problem. Further such approaches are not compatible with field usage, and often result in relatively inaccurate results.

The present invention is an attempt to solve the problem by the selection of a binder material which has the characteristics of being self-cooling, as well as being resistant to loading or clogging. Such binder material has been found to exist in polytetrafluoroethylene and other similar "stick resistant" resins such as polymonochlorotrifluorethylene. Polytetrafluoroethylene (known as Teflon TM and Silver Stone TM, both trademarks of DuPont) has been utilized in such products as cookware, bearings, rollers, gaskets, tubing, and electrical insultation. However, to date, it is not believed that polytetrafluoroethylene has been utilized as the binder matrix in which the abrading particles are embedded to form abrasive tools. Polytetrafluoroethylene has a unique combination of characteristics particularly adaptable for forming the binder matrix. Such characteristics include a very high melting temperature (614° F.) and an extremely stubborn resistance to sticking or adhering to other materials.

Therefore, in general the present invention is directed to a self-cooling, non-loading abrading tool for sanding, grinding, or polishing work pieces which tool is formed by embedding the multiplicity of abrasive particles (such as 4% silica sand) in a binder matrix formed primarily of virgin polytetrafluoroethylene. The binder matrix may further include a stiffening agent such as ground glass (15%–25%).

The abrading tool may be molded or formed in a variety of sizes, shapes and configurations such as wheels, discs, plain and tapered cups, sheets, pads, and the like. Abrading tools formed in compliance with the present invention may be utilized in connection with the grinding of ferrous and non-ferrous materials including such difficult materials to abrade as fiber glass and aluminum. The abrasive particles may include, in addition to silica sand, diamond, carborundum, garnet, alumimum oxide, pumice, rouge, tripoli, and the like.

Although the abrading tool according to the present invention is primarily designed to be used without any type of coolant, it can also be used with splash water or coolant if desired. The primary feature of the invention is the non-loading or non-clogging characteristic. Additionally, the heat generated by the abrading operation is minimized as the only temperature increase occurs in the abrasive particles themselves, the polytetrafluoroethylene being substantially frictionless because of the substitution of fluorine for hydrogen in the polymer.

Tests have shown that such abrading wheels or discs may be operated in excess of 5000 rpm. Other possible variations in the material of the binder matrix include polymonochlorotrifluoroethylene, however, even though it is also very resistant to sticking to other materials (and thus non-clogging), the melting point is only approximately 300° F.

It is therefore an object of the present invention to provide a self-cooling, non-loading abrading tool.

It is another object of the present invention to provide a tool of the type described in which the abrasive particles are embedded in a binder matrix that is resistant to sticking.

It is yet another object of the present invention to provide a tool of the type described in which the binder matrix is formed primarily of polytetrafluoroethylene.

Figure 6:
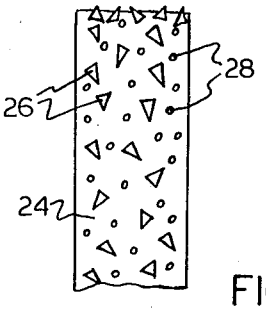

Other objects and a fuller understanding of the invention will become apparent from reading the following detailed description of a preferred embodiment along with accompanying drawings, in which:

FIGS. 1–5 are partial perspective views illustrating various configurations of the abrading tool according to the present invention; and FIG. 6 is a sectional view taken substantially along lines 6—6 in FIG. 1 illustrating the make-up of the abrading tool according to the present invention.

DETAILE DESCRIPTION OF A PREFERRED EMBODIMENT

Figure 3:
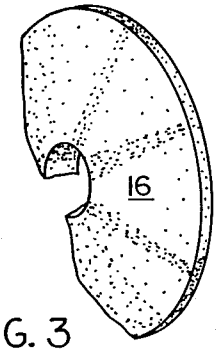
Figure 4:
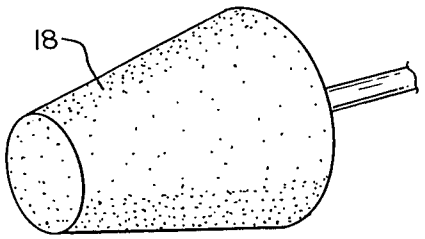
Figure 5:
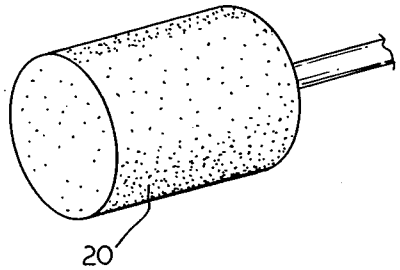

Turning now to the drawings, there are illustrated in FIGS. 1–5 several possible configurations of an abrading tool in which the features of the present invention might be incorporated. Thus, in FIG. 1, there is a plain disc shaped grinding wheel 10 in which the body of the tool is formed substantially entirely of abrasive particles embedded in the binder matrix of the present invention as will be explained hereinafter. The disc 12 of the present invention (FIG. 2) is provided with a peripheral coating or rim 14 formed of the abrasive particles embedded in the binder matrix. In this embodiment, the base member 12 may be formed of any conventional support material such as metal, ceramic, stone, and the like. The disc 16 of FIG. 3 is similar to the configuration shown in FIG. 1 except the circular surfaces are tapered inwardly from the center toward the edge. In FIG. 4 there is provided a tapered cup 18 and in FIG. 5 there is shown a cylindrical cup 20. In either of the embodiments illustrated in FIGS. 4 or 5 the cup may be formed entirely of abrasive particles embedded in the binder matrix, or the surface may be coated with a layer of abrasive particles embedded in the binder. The configurations described above are exemplary only as other shapes for tools are envisioned.

Turning now to FIG. 6 there is illustrated an enlarged cross-sectional view of a portion of the binder containing the abrasive particles. The open spaces 24 of FIG. 6 represent the binder material which, in the present invention is preferably polytrafluoroethylene. As stated hereinabove, an alternative binder material is polymonochlorotrifluoroethylene. The abrasive particles 26 are embedded in the polytetrafluoroethylene, and may be silica sand, either diamond particles, carborundum, garnet, aluminum oxide particles, pumice, rouge, tripoli, or such other conventional abrasive particles. Grit size is preferably in the range of 80 to 50,000 microns.

If desired, a minor portion of stiffening agent 26 may be added to the binder for increased rigidity. Such stiffening agents include 15%–25% ground glass.

Discs formed of silica sand embedded in polytetrafluoroethylene have been used to cut fiber glass with excellent results. The cut is clean, smooth, and with no torn edges. The same disc has been used with excellent results on aluminum, copper, brass, plexiglass, and high speed steel with no loading of the abrasive surface and without noticeable generation of heat. Different discs impregnated with diamond grit were used with good results on the shaping and polishing of stones such as turquoise, quartz, opal, jade, and ruby.

It should be recoginized that, while several shapes of abrading tools are illustrated and described hereinabove, many other configurations exist with which the abrasive particle binder matrix of the present invention might be utilized. The heart of the present invention lies in the utilization of the polytetrafluoroethylene and equivalent materials as the primary binder matrix material for an abrasive tool, regardless of the tool configuration. The polytetrafluoroethylene combines the characteristics of low heat conductivity and a high resistance to sticking to provide an effective anti-clogging abrasive tool. The present invention is, therefore, set forth in the accompanying claims.

What is claimed is:

1. A self-cooling, non-loading abrading tool for sanding, grinding, or polishing a work piece comprising a plurality of abrasive particles embedded in a binder matrix, said binder matrix formed of at least 75% by weight of a polymeric resin selected from the group containing polytetrafluoroethylene and polymonochlorotrifluoroethylene.

2. The tool according to claim 1 wherein said abrasive particles are substantially 4% by weight silica sand.

3. The tool according to claim 1 wherein said binder matrix further includes a stiffening agent for purposes of increased rigidity.

4. The tool according to claim 3 wherein said stiffening agent is ground glass and comprises substantially 15%–25% by weight of the binder.

* * * * *